United States Patent [19]

McManus et al.

[11] Patent Number: 4,538,682

[45] Date of Patent: Sep. 3, 1985

[54] METHOD AND APPARATUS FOR REMOVING OIL WELL PARAFFIN

[76] Inventors: James W. McManus, 515 San Salvador Dr., Dunedin, Fla. 33528; Elmer Winckler, 3605 Arctic Blvd., #241, Anchorage, Ak. 99503; James Backus, 4123 Wills Rd., Cheyenne, Wyo. 82001

[21] Appl. No.: 530,366

[22] Filed: Sep. 8, 1983

[51] Int. Cl.[3] ..... E21B 36/04; E21B 37/00

[52] U.S. Cl. ..... 166/255; 166/304; 166/311; 166/60

[58] Field of Search ..... 166/250, 254, 255, 302, 166/304, 311, 60, 61

[56] References Cited

U.S. PATENT DOCUMENTS

| | | |
|---|---|---|
| 806,039 | 11/1905 | Williamson et al. . |
| 2,561,249 | 2/1949 | Tomlinson . |
| 2,598,280 | 5/1952 | McLean . |
| 2,781,851 | 2/1957 | Smith . |
| 3,207,220 | 9/1965 | Williams . |
| 3,213,942 | 10/1965 | Nixon . |
| 3,454,094 | 7/1969 | Grolemund et al. . |
| 3,507,330 | 4/1970 | Gill . |
| 3,547,193 | 12/1970 | Gill . |
| 3,605,888 | 9/1971 | Crowson et al. . |
| 3,614,986 | 10/1971 | Gill . |
| 3,620,300 | 11/1971 | Crowson ..... 166/248 |
| 3,642,066 | 2/1972 | Gill ..... 166/248 |

OTHER PUBLICATIONS

Paraffin and Congealing-Oil Problems, 1934, pp. 90-93.

*Primary Examiner*—Stephen J. Novosad
*Assistant Examiner*—William P. Neuder
*Attorney, Agent, or Firm*—Price, Heneveld, Huizenga & Cooper

[57] ABSTRACT

A method of removing paraffin build up from an oil well which includes determining the location of a cooler portion of the oil well at which paraffin build up occurs, introducing an inductance heating element down into the annular space between the oil well tubing and the oil well casing, positioning the inductance heating element in the vicinity of the cooler portion and inductance heating the inside surface of the oil well tube to at least the temperature about that of the melting point of paraffin. Preferably, the inside surface of the tube is heated on the down stroke of the oil well sucker rod and at the start of the sucker rod up stroke in order to strip the paraffin from the tubing. The outside surface of the sucker rod is heated on its up stroke and the inductance heater has multiple bands of coil to heat the same general area of the sucker rod as it travels.

46 Claims, 8 Drawing Figures

METHOD AND APPARATUS FOR REMOVING OIL WELL PARAFFIN

BACKGROUND OF THE INVENTION

The present invention relates to oil well servicing and in particular to a method and apparatus for the removal of paraffin build up from the inside of an oil well.

Almost every working oil well experiences problems with paraffin build up on the inside of the production tubing. This build up may occur on the inside surface of the production tubing or also on the sucker rod which reciprocates within the tubing. This paraffin build up forms a restriction in the tubing and reduces the productivity of the oil well. Consequently, almost every oil well must be periodically serviced to remove the paraffin build up in order to permit the free flow of oil through the production tubing.

Heretofore, various methods of removing paraffin build up from oil wells have been employed. In some wells, the production tubing must be removed from the casing and each individual section checked for paraffin build up while the tubing is above ground. This method requires that a portable rig be transported to the oil well site and erected in order to pull the production tubing string. This process is very expensive and requires that the oil well be shut down for considerable lengths of time in order to pull, clean and replace the production tubing.

Another method used for paraffin removal has been to heat some type of fuel above the ground surface and then pump the hot fuel down into the oil well. The heated fuel heats the production tubing and melts any paraffin build up along its length. This method is very dangerous in that the fuel must often be heated to temperatures as high as 200° F., and when so heated is subject to many accidents such as accidental releases or fires that result in great injury or loss of life.

A third method attempted in the past has been to place a resistance heating element down in the oil well casing an an attempt to heat the tubing string and the oil flowing therein. Many such attempts have been unsuccessful since these heaters have been used to resistance heat the oil tubing from the outside in as well as the oil flowing therethrough. If the convection produced by the moving oil does not prevent the tubing from reaching the proper temperature, this resistance heating along major portions of the production tubing string requires very large amounts of energy. These large energy demands are very costly and often difficult to produce at a working oil well site.

SUMMARY OF THE INVENTION

In one aspect, the present invention recognizes that paraffin build up typically occurs at cold spots produced by subsurface formations, most notably subsurface cold water streams. The paraffin build up is removed from the oil well by the apparatus and method for determining the location of the cooler portions of the oil well and introducing a heating element down into the well at said location. The heating element, preferably an induction heater, is positioned in the vicinity of the cooler portion that has been previously determined. The cooler portion of the oil well is then periodically heated to at least the temperature about that of the melting point of paraffin. Preferably, this method includes the logging of the oil well to determine the location of subsurface cold water streams and the heating element is positioned in the vicinity of the cold water streams.

In another aspect of the invention, paraffin build up is removed from an oil well by an apparatus and method for determining the location of paraffin deposit in the oil well and then introducing an inductance heating element into the annular space between the oil well casing and the oil well tube. The inductance heating element is then used to heat the inside surface of the oil well tube to at least the temperature about that of the melting point of paraffin.

The present invention provides a low energy method and apparatus for oil well paraffin removal that can be economically supplied at the oil well site without removal of the production tubing from the oil well. The entire production string is not required to be heated, but rather only specific, previously determined locations. With this low energy method, the production string may remain in the casing and liquids are not required to be heated to dangerously high temperatures above the ground surface.

To remove paraffin, only the inner surface of the oil tubing is required to be heated. This may be accomplished with inductance heating. A short impulse can be used to quickly heat a short section of oil well tube to release a built up deposit of paraffin so that it will flow out of the production string with the oil, rather than re-adhering to the tubing wall. The inductance heating can be controlled to also heat the exterior surface of the sucker rod, so that the heater element is not required to heat the entire production tubing string as well as the oil flowing therethrough.

These and other features, advantages and objects of the present invention will be further understood and appreciated by those skilled in the art by reference to the following written specifications, claims and appended drawings.

DETAILED DESCRIPTION OF THE PREFERRED EMBODIMENTS

Figure 1:
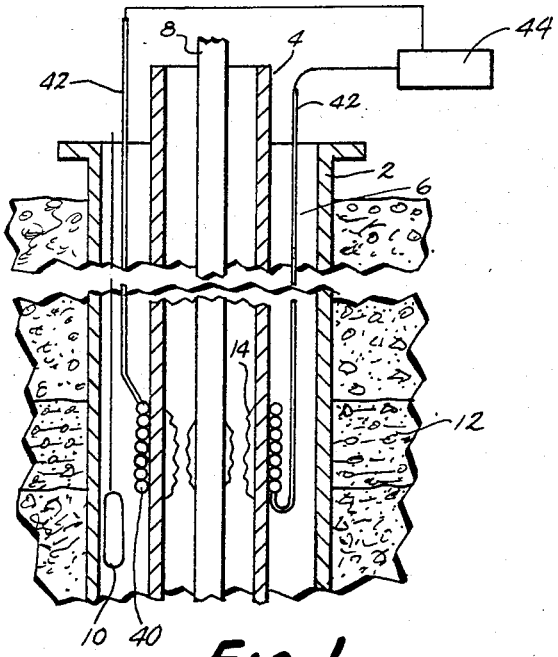
FIG. 1 is a fragmentary, sectional view of an oil well with a heating element positioned therein embodying the present invention.

In the preferred embodiment, the location of a build up of paraffin is determined in the vicinity of a subsurface cold water stream, shown generally in FIG. 2. An inductance heating coil is then positioned down in the oil well around the oil tubing, shown generally in FIG. 1, and the inner surface of the tubing is heated through inductance in order to melt the paraffin deposit loose.

As shown in FIGS. 1, 2A, 2B, 2C, 3, 4 and 5, an oil well has a casing 2 that contains a production string of oil tubing 4. The diameter of tubing 4 is less than that of casing 2 so that an annular space 6 is formed between tubing 4 and casing 2. Depending upon the particular oil well, the diameter of tubing 4 varies from one and one half inches to approximately five and one half inches. The diameter of casing 2 also varies so that the width of annular space 6 varies, but normally is greater than one half inch. Within tubing 4 is a sucker rod 8 that includes a valve (not shown) located at its lower end so that sucker rod 8 may be used to lift oil to the surface through tubing 4 as is well known in the art.

When an oil well is being drilled, the well hole is normally logged to determine a well profile of surrounding geological formations. For this purpose a sonde 10 is lowered down through the well by conventional cable and winch apparatus and various types of signals are used to obtain a geological profile along the oil well. Various well logging methods and apparatus are well known in the art and include induction, acoustic and neutron logs. An extensive description of well logging apparatus and methods is includes in *Lessons In Well Servicing and Workover, Well Logging Methods Lesson* 3, A Home Study Course Issued by Petroleum Extension Service, the University of Texas at Austin (1971). Such services are presently provided by Schlumberger Well Services and Welex Company, both of Houston, Tex.

Figure 2A:
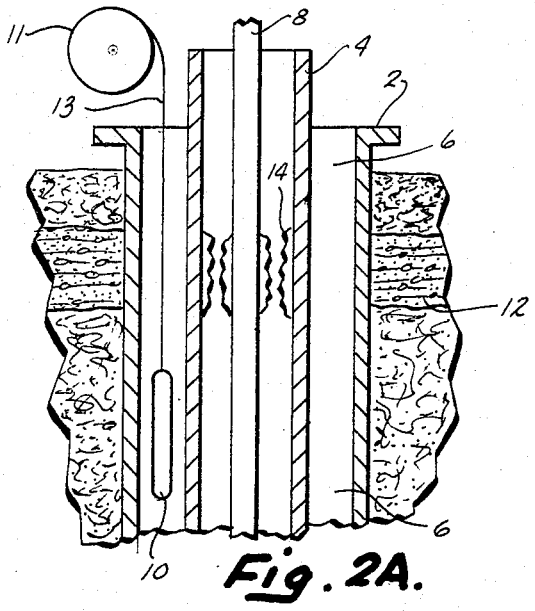
FIGS. 2A, 2B and 2C are fragmentary, sectional views of an oil well shown with different apparatus for determining the location of paraffin deposits in each of them.

In accordance with one aspect of our invention, the well is first logged to determine the locations of subsurface cold water streams 12 that pass around casing 2 (FIG. 2). For this purpose a cable and winch arrangement is utilized comprising a winch 11 and cable 13 on the end of which is the temperature sensor 10 of the type such as used by Schlumberger Well Services of Houston, Tex. The location of such streams 12 is done because we believe that such streams 12 reduce the temperature of casing 2 and tubing 4 therein, which causes a paraffin build up 14 on tubing 4 in that vicinity. Although, well logging as described in the above "Lessons" may possibly be used for determining the location of such cold streams and other cold areas we prefer to log the well temperature by a temperature sensor 10 as disclosed in FIG. 2A.

After these cold strata of the well are determined, we lower a heater preferably an inductance heater to the location of the cold strata for heating and melting any paraffin deposits which had or may form as will be described in greater detail hereinafter.

In the alternative to determining the locations at which paraffin build up will occur prior to it being deposited, the present apparatus and method also contemplates determining the location of paraffin build up after it has collected in the tubing.

Figure 2B:
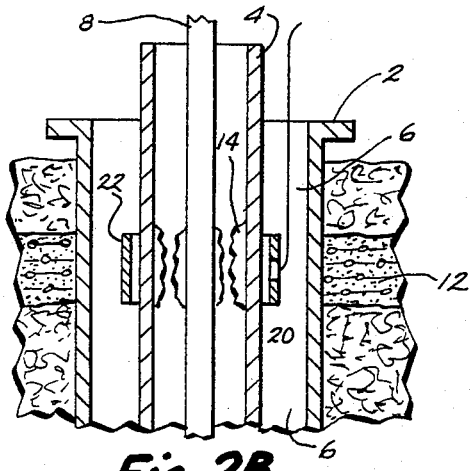
Figure 2C:
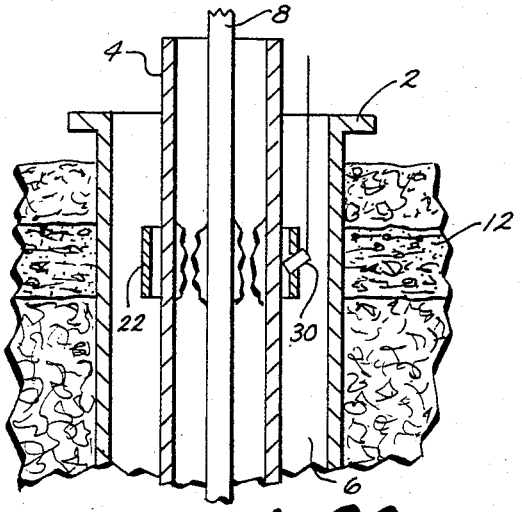

As shown in FIG. 2B, an ultrasound transducer 20 is introduced into annular space 6. Transducer 20 includes a circular ring 22 that holds transducer 20 adjacent tubing 4. Preferably, transducer 20 operates on a frequency of 2 MHz or higher and on a pulse length of 1 μsec. or shorter. Transducer 20 is connected to a cathode ray tube (CRT) or a line printer as is conventionally known to those skilled in the art. The ultrasound echoes are displayed as a picture on the CRT to determine the location of paraffin build up as transducer 20 is lowered along the length of tubing 4. An example of such a transducer is a system marketed under the trade name "Type 3405 Ultrasound Scanning System" by Bruel & Kjaer Instruments, Inc. of Marlborough, Mass., which operates on a frequency of as high as 5.5 MHz.

An alternative method of determining locations of paraffin build up 14 is to orient an ultrasound transducer 30 (FIG. 2C) in circular ring 22 at a downward facing angle. Oriented at such an angle, the signal emitted by transducer 30 experiences a "doppler effect" due to the oil moving through tubing 4 on the upstroke of sucker rod 8. Paraffin thickness may be determined by one skilled in the art in a conventional manner due to the time delay of the "doppler" affected signal. Transducer 30 is connected to a line printer or a CRT as is known in the art in order to record the "doppler" effect produced on the ultrasound signal. An example of such a transducer is marketed under the trade name "Kay Digital Sona-Graph, Model 7800" by Kay Elemetrics Corporation of Pine Brook, N.J., which operates at frequencies up to 10 MHz.

After the location of cold areas and/or paraffin build up 14 has been determined an inductance heating coil 40 (FIG. 1) is positioned in annular space 6 in the vicinity of paraffin deposit 14. The coil 40 is connected to cable 42 for powering the coil and that includes a support cable that coil 40 is supported by and electrical leads connected to source of power 44.

Inductance heater 40 is used to heat the inner wall of tubing 4 in the vicinity of deposit 14 without substantially heating the remainder of tubing 4. The heating of the inner surface of tubing 4 is a function of the frequency of the current passed through coil 40 and the physical properties of tubing 4. It is well known by those skilled in the art the manner of altering the frequency of the current through coil 40 to change the depth or location in tubing 4 that the heating occurs. Given the dimensions and type of pipe to be heated, the frequency required for the inside of the pipe to correspond to the inductance heating skin depth may be readily calculated using the equation:

$$\text{frequency} = [2.6/\delta]^2[(1/\mu_r)(P/pc)].$$

Where $\mu_r$ is the relative permeability of the tubing, P/pc is the relative resistivity of the pipe compared to copper, and $\delta$ is the skin depth as well as the thickness of the pipe. At the skin depth location, the heating is 36.8% of that of the surface heating, therefore the tubing is predominantly heated without excessive heating of the internal oil.

Also given the physical dimensions and properties of the tubing to be heated, one skilled in the art may readily calculate the amount of power required to raise a short section of tubing 4 into the range of the melting point of paraffin wax, which is 123° F.–146° F. (50° C.–63° C.).

Since the inductance heating is used to raise the temperature of a short section of tubing 4, heater 40 is not required to heat the remainder of tubing 4 and the oil passing within. Due to this localized concentration of heating, the power necessary to raise the temperature of the inner surface of tubing 4 is preferably applied in a large impulse. This impulse requires a large amount of power, but since the power is applied for a short period of time the average power requirements for the system are relatively low. A continuous low level power source may supply power to a storage device in order to produce the necessary energy for the impulse.

During the down stroke of sucker rod 8, the oil within tubing 4 is generally stationary relative to tubing 4. The induction heating impulse normally is applied during the down stroke of sucker rod 8 so that the oil will not cause convection of the resulting heat away from the inside surface of tubing 4. Preferably, the impulse continues over onto the beginning of the sucker rod up stroke so that after the inner wall of tubing 4 is heated to loosen paraffin 14, the up stroke of sucker rod 8 strips away the paraffin build up. The globules of paraffin are then suspended in the oil and may be removed above the surface by a conventional filtering process. It is believed that once the paraffin globules have been stripped from tubing 4, these globules will flow with the oil and not re-adhere to tubing 4.

Figure 3:
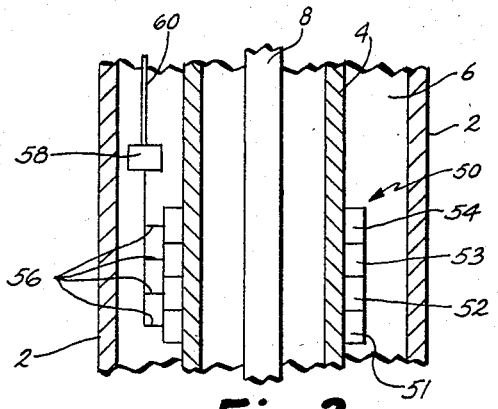
FIG. 3 is a fragmentary, sectional view of an oil well with an overlapping heating element therein presenting a second preferred embodiment.

An alternative inductance coil 50 is shown in FIG. 3. Inductance coil 50 is made up of four adjacent bands of inductance coiling 51, 52, 53 and 54. Bands 51–54 are each an individual inductance heater but are positioned immediately adjacent each other so that a single continuous heating element 50 is formed. This permits coil 50 to produce a "moving" heating impulse. Each band 51–54 has its own set of electrical leads 56 which are all connected to an electronic switch 58. An electrical cable 60 runs to the surface carrying two cables for supplying power for the inductance heating element and control wires to electronic switch 58.

Inductance heater 50 is used to produce a heating impulse that travels along the length of tubing 4. Electronic switch 58 controls which band is to be activated so that bands 51–54 are each activated in succession, thus allowing a larger section of tubing 4 to be heated while maintaining a low power requirement. The heating impulse may be channeled to specific portions of a cold section rather than heating the entire cold section at a single time. Preferably, to insure that gaps of deposit are not left between freed areas of tubing 4, two adjacent bands would be activated simultaneously in overlapping sequence. For example, heating bands 51 and 52 would be activated on the first cycle. On the second cycle, bands 52 and 53 would be activated, with the process repeated for the remainder of the cold section.

Inductance heater 50 is also used to heat the outer surface of sucker rod 8 in order to clear it of paraffin build up without requiring that the surrounding oil be heated. As the sucker rod begins its up stroke, the frequency of the applied impulse is lowered to a predetermined frequency and the current generating this impulse is increased so that the skin depth or location of the inductance heating is increased. This shifts a portion of the inductance heating to the outer surface of the sucker rod during the up stroke. The frequency in current necessary to shift this heating location may be routinely calculated by one skilled in the art for a particular oil well given the dimensions and material used in the oil well.

To clean the sucker rod, the impulses are applied during the up strokes of the sucker rod since the oil within tubing 4 is traveling with rod 8 at that time and therefore is generally stationary relative to sucker rod 8. Electronic switch 58 is controlled to activate bands 51–54 in sequence to follow sucker rod 8 and thereby heat the same general area on its surface. Although a single band heater element 40, FIG. 1, could be used to heat and free the surface of sucker rod 8, the use of a multiple band element 50 is preferable because the heating impulse will be concentrated substantially on the same area throughout the impulse.

Figure 4:
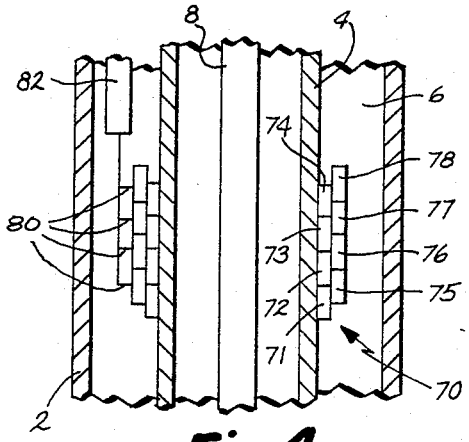
FIG. 4 is a fragmentary, sectional view of an oil well with a heating element and control positioned therein presenting a third preferred embodiment.

An overlapping multiple band heater element 70 is depicted in FIG. 4. A first column of bands of conductance coil 71, 72, 73 and 74 are immediately adjacent each other and encircle tubing 4. A second column of adjacent bands 75, 76, 77 and 78 encircle the inner bands and are staggered so as to overlap two adjacent bands 71–74 of the inner column. A set of electrical leads 80 connect to each band 71–78 and run up to the surface in a cable 82. An electronic switch above the ground surface or alternatively one within the casing, as in FIG. 3, controls the independent activation of the various bands 71–78.

Overlapping band heater coil 70 is also used to produce an impulse that travels along the length of tubing 4. Heater element 70 insures that gaps will not be left between heated areas by simultaneously activating an overlapping pair of bands, one from the inner column 71–74 and one from the outer column 75–78. For example, bands 71 and 75 are simultaneously activated first, followed by the simultaneous activation of bands 72 and 76.

Figure 5:
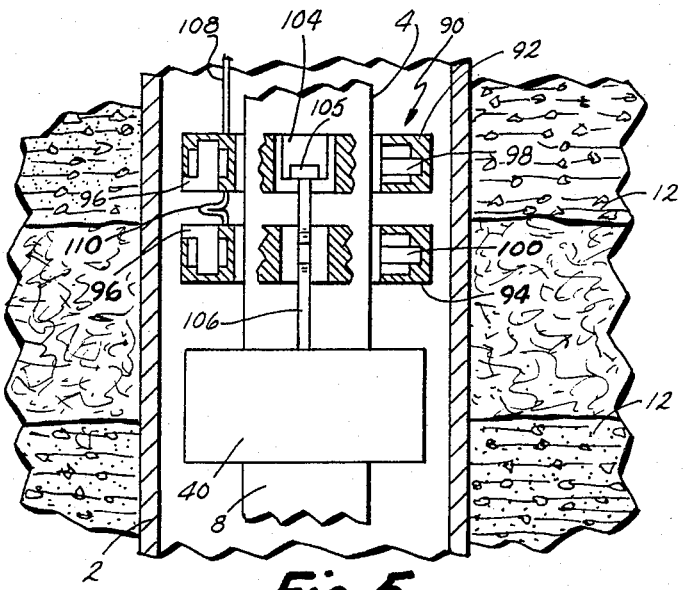
FIG. 5 is a fragmentary, sectional view of an oil well with a heating element and a positioning device located therein presenting a fourth preferred embodiment.

As shown in FIG. 5, an inductance heater element 40 is supported by a positioning device 90 that moves element 40 along tubing 4. Positioning device 90 has an upper collar 92 and a lower collar 94 that encircle tubing 4. Spaced about collars 92, 94 are variable electromagnets 96 that are used to propel positioning device 90. Electromagnets 96 on upper collar 92 are spaced to correspond to electromagnets 96 on lower collar 94 so that each electromagnet 96 faces a corresponding electromagnet on the opposite collar. Spaced about upper collar 92 are a series of locking electromagnets 98 and spaced about lower collar 94 are a similar series of locking electromagnets 100. Locking electromagnets 98, 100 are oriented to face inward to tubing 4 to lock collars 92 and 94 onto tubing 4 during the shifting process. A bolt 102 is threaded into lower collar 94 and is slidably received in an aperture 104 in upper collar 92. Bolt 102 has an enlarged head 105 that is received in an enlarged upper portion of aperture 104. A linking rod 106 connects heater element 40 to lower collar 94.

An electrical cable 108, FIG. 5., connects upper collar 92 to electric controls above the ground surface and electrical leads 110 run from upper collar 92 to lower collar 94. Using positioning device 90 heater element 40 can be moved from one cold portion of the oil well to another, such as is the case when more than one subsurface cold water stream 12 passes around casing 2. To move upward locking electromagnets 100 on lower collar 94 are activated to lock collar 94 to tubing 4. Variable electromagnets 96 are then activated so as to have the same polarity and therefore repel each other. Upper collar 92 is raised by this repulsion and bolt 102 keeps collars 92, 94 aligned. Upper locking electromagnets 98 are then activated to lock upper collar 92 to tubing 4 and lower locking electromagnets 100 are deactivated to release lower collar 94. The polarity of variable electromagnets 96 is then altered so that the magnets on upper and lower collars 92, 94 attract each other in order to lift lower collar 94. This process is repeated until heater element 40 is positioned in the new cold location. In order to lower heater element 40, this process is simply reversed. When upper collar 92 is locked to tubing 4, variable electromagnets 96 are simply deactivated and the weight of lower collar 94 and heater element 40 will cause collar 94 to drop. Bolt 102 prevents lower collar 94 from falling down into the oil well.

In the alternative to the use of electromagnets within positioning device 90, positioning device 90 may operate hydraulically or utilize small electric motors or the like for propulsion.

EXAMPLE 1

Figure 6:
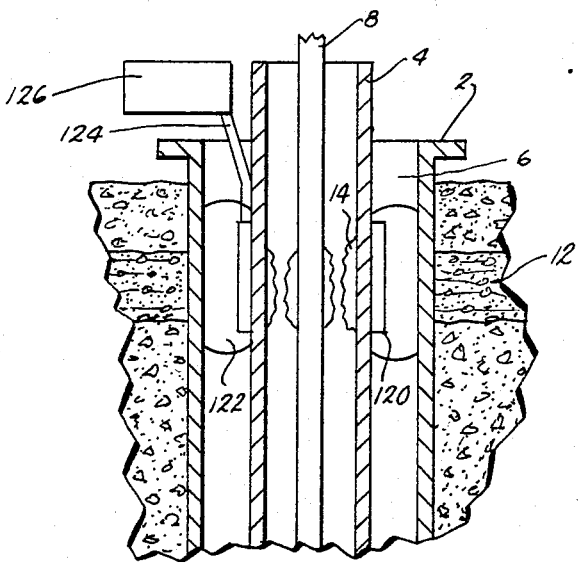
FIG. 6 is a fragmentary, sectional view of an oil well presenting a fifth preferred embodiment.

In some applications between casing 2 and tubing 4 of the oil well is a fluid, such as water or mud. In such situations as tubing 4 is heated the fluid will also heat. The heated fluid then carries heat away from the desired location on tubing 4 due to convection. Shown in FIG. 6 is an inductance heater 120 used in such fluid convecting applications. Inductance heater 120 has an insulated covering and has an inflatable, flexible, tubular air bag or plenum 122 secured about its circumference that is used to prevent fluid convection. Connected to inductance heating coil 120 is a cable 124 that both supports coil 120 and carries electrical leads as described for the embodiments above. Cable 124 also contains gas lines that supply inflating gas to air bag 122 and are connected to a suitable gas source 126 located above the ground surface, such as an air compressor, compressed air tank or the like.

When heater 120 is positioned within the well, gas is supplied to air bag 122 until it is inflated. When inflated, air bag 122 is pressed against both casing 2 and tubing 4, surrounding heater 120, sealing annular space 6. Air bag 122 both prevents fluid from convecting past heater 120 and insulates heater 120 from the surrounding fluid. Air bag 122 is deflated in order to move heater 120.

If the inside surface of a pipe made of SAE 1045 steel that has an outside diameter of 2.4 inches and an inside diameter of 2.0 inches is to be heated, the frequency required of an inductance heater coil positioned around the outside diameter of this pipe would be approximately 169 Hz. Assuming a temperature rise of 75° C. were required to achieve the melting range of paraffin wax, an impulse of approximately 16.64 Kw would be applied for three seconds. In order to remove paraffin from the tubing at a rate of 10 feet per hour using a heater element six inches long and having twelve turns of one half inch diameter copper coil, the average power requirement would be approximately 333 watts, with a "pulse" current of 1429 amps and an applied voltage of 11.64 volts.

EXAMPLE 2

A small amount of water was placed in a pipe having a 1.05 inch outside diameter and a 0.81 inch inside diameter and a 60 cycle welder was used as a power source to drive 295 amps through the inductance heater at 10 volts. The heater element has a 10 inch coil that had 90 turns. This system boiled water in the pipe in approximately 4 seconds.

This process provides an inexpensive and efficient method of removing paraffin deposits from within the oil well. Various configurations of heater elements may be used, as well as various devices for locating the paraffin build up within the well. Although it is believed that once the paraffin build up is knocked free from the inner surface of the production string it will not re-adhere, in the event that some re-adherence does occur, an inductance heater can again be used to remove this build up.

It will be understood by those skilled in the art that the above is merely a description of the preferred embodiments and that various improvements or modifications can be made without departing from the spirit of the invention disclosed herein. The scope of the protection afforded the invention is to be determined by the claims which follow and the breadth of interpretation which the law allows.

The embodiments of the invention in which an exclusive property or privilege is claimed are defined as follows:

1. A method of removing paraffin build up from an oil well that includes tubing and a casing, comprising:

determining the location of a temperature gradient in the oil well, the temperature gradient including a relatively low temperature portion;

introducing a heating element into the oil well;

positioning the heating element in the vicinity of the relatively cooler portion;

selectively heating the relatively cooler portion of the oil well to at least the temperature about that of the melting point of paraffin without imparting a substantial amount of heat to portions of the oil well other than the relatively cool portion.

2. The method as defined in claim 1, wherein the oil well has a sucker rod and said heating step includes heating a portion of the oil well tube on the down stroke portion of the sucker rod cycle.

3. The method as defined in claim 2, wherein said heating step further includes heating the outer surface portion of the sucker rod on the up stroke portion of the sucker rod cycle.

4. The method as defined in claim 3, wherein said determining step includes determining the location of water flow around the exterior of said oil well casing.

5. The method as defined in claim 4, wherein said heating element introducing step includes introducing an inductance heating element into the oil well;

said positioning step includes positioning the inductance heating element over a limited, selected area of the oil well; and said heating step includes inductance heating substantially only the limited, selected area covered by the inductance heater.

6. The method as defined in claim 5, wherein said determining step includes determining a plurality of locations of temperature gradients;

shifting the heating element from the vicinity of a temperature gradient to the vicinity of each of the other temperature gradients after said heating step and heating those other locations.

7. The method as defined in claim 5, wherein said determining step includes determining a plurality of locations of temperature gradients;

said introducing step includes introducing a plurality of heating elements into the oil well and said positioning step includes positioning a heating element in the vicinity of each of the temperature gradients.

8. The method as defined in claim 2, wherein said heating step further includes heating the outer surface portion of the sucker rod on the up stroke portion of the oil well sucker rod cycle.

9. The method as defined in claim 8, wherein said heating element introducing step includes introducing an inductance heating element into the oil well;

said positioning step includes positioning the inductance heating element over a limited, selected area of the oil well; and said heating step includes inductance heating substantially only the limited, selected area covered by the inductance heater.

10. The method defined in claim 1, wherein said heating step includes predominately heating only the oil well tube.

11. The method as defined in claim 1, wherein said determining step includes taking a temperature log along the length of the oil well.

12. The method as defined in claim 11, wherein said heating element introducing step includes introducing an inductance heating element into the oil well;

said positioning step includes positioning the inductance heating element over a limited, selected area of the oil well; and said heating step includes inductance heating substantially only the limited, selected area covered by the inductance heater.

13. The method as defined in claim 1, wherein said determining step includes determining the location of water flow around the exterior of the oil well casing.

14. The method as defined in claim 13, wherein said heating element introducing step includes introducing an inductance heating element into the oil well;

said positioning step includes positioning the inductance heating element over a limited, selected area of the oil well; and said heating step includes inductance heating substantially only the limited, selected area covered by the inductance heater.

15. A method of removing paraffin build up from an oil well that includes tubing and a casing, comprising:

determining a location of paraffin deposit in the oil well;

introducing an inductance heating element into the annular space between the oil well casing and the oil well tube;

inductance heating the oil well tube at said determined location to at least the temperature about that of the melting point of paraffin, said inductance heating occurring in electrical pulses of relatively short duration.

16. The method as defined in claim 15, wherein the oil well includes a sucker rod and said heating step includes heating the inside surface portion of the oil well tube on the down stroke portion of the oil well sucker rod cycle.

17. The method as defined in claim 16, wherein said heating step includes heating the inside surface of the oil well during the beginning portion of the up stroke of the oil well sucker rod to strip the paraffin build up from the inside surface of the oil well tubing.

18. The method as defined in claim 17, wherein said heating step further includes heating the outer surface portion of the sucker rod on the up stroke portion of the oil well sucker rod cycle.

19. The method as defined in claim 18, wherein said determining step includes introducing an ultrasound transducer into the annular space between the oil well tubing and the oil well casing.

20. The method as defined in claim 19, wherein said introducing step includes introducing an inductance heating element having a plurality of adjacent bands of inductance heater portions, said heating step including selectively activating the individual bands of said inductance heater element to shift the portion of the oil well tubing being heated.

21. The method as defined in claim 20, wherein said determining step includes determining a plurality of locations of paraffin build up and moving the inductance heater from one paraffin deposit to another location of paraffin deposit after said heating step.

22. The method as defined in claim 15, wherein the oil well includes a sucker rod and said heating step includes inductance heating the outer surface of the oil well sucker rod on the up stroke portion of the oil well sucker rod cycle.

23. The method as defined in claim 22, wherein said introducing step includes introducing an inductance heating element having a plurality of adjacent bands of inductance heater portions, said heating step including selectively activating the individual bands of said inductance heater element to shift the portion of the oil well tubing being heated, the bands being activated in succession corresponding to the rate of movement of the oil well sucker rod so that the bands all heat the same general area of the sucker rod.

24. The method as defined in claim 15, wherein said determining step includes introducing an ultrasound transducer into the annular space between the oil well tubing and the oil well casing.

25. The method as defined in claim 24, wherein said heating step includes heating the inside surface portion of the oil well tube on the down stroke portion of the oil well sucker rod cycle.

26. The method as defined in claim 25, wherein said heating step includes heating the inside surface of the oil well during the beginning portion of the up stroke of the oil well sucker rod to strip the paraffin build up from the inside surface of the oil well tubing.

27. The method as defined in claim 15, wherein the oil well includes a sucker rod and said determining step includes projecting an acoustical signal angularly into the oil well tubing and monitoring the acoustical signal on the up stroke portion of the sucker rod cycle.

28. The method as defined in claim 27, wherein said heating step includes heating the inside surface portion of the oil well tube on the down stroke portion of the oil well sucker rod cycle.

29. The method as defined in claim 28, wherein said heating step includes heating the inside surface of the oil well during the beginning portion of the up stroke of the oil well sucker rod to strip the paraffin build up from the inside surface of the oil well tubing.

30. The method as defined in claim 15, wherein said determining step includes taking a temperature log along the length of the oil well and locating a temperature gradient, the temperature gradient including a relatively cooler area.

31. The method as defined in claim 30, wherein said heating step includes heating the inside surface portion of the oil well tube on the down stroke portion of the oil well sucker rod cycle.

32. The method as defined in claim 31, wherein said heating step includes heating the inside surface of the oil well during the beginning portion of the up stroke of the oil well sucker rod to strip the paraffin build up from the inside surface of the oil well tubing.

33. The method as defined in claim 15, wherein said determining step includes determining the location of water flow around the outside of the oil well casing.

34. The method as defined in claim 33, wherein said heating step includes heating the inside surface portion of the oil well tube on the down stroke portion of the oil well sucker rod cycle.

35. The method as defined in claim 34, wherein said heating step includes heating the inside surface of the oil well during the beginning portion of the up stroke of the oil well sucker rod to strip the paraffin build up from the inside surface of the oil well tubing.

36. The method as defined in claim 15, wherein said introducing step includes introducing an inductance heating element having a plurality of adjacent bands of inductance heater portions, said heating step including selectively activating the individual bands of said inductance heater element to strip the portion of the oil well tubing being heated.

37. The method as defined in claim 36, wherein said introducing step includes introducing an inductance heating element in which each band overlaps an adjacent band.

38. The method as defined in claim 36, wherein said heating step includes heating the inside surface portion of the oil well tube on the down stroke portion of the oil well sucker rod cycle.

39. The method as defined in claim 38, wherein said heating step includes heating the inside surface of the oil well during the beginning portion of the up stroke of the oil well sucker rod to strip the paraffin build up from the inside surface of the oil well tubing.

40. The method as defined in claim 38, wherein said heating step further includes heating the outer surface portion of the sucker rod on the up stroke portion of the oil well sucker rod cycle.

41. The method as defined in claim 15, further comprising introducing means for blocking fluid flow between the oil well tubing and casing; blocking the flow of fluid between the oil well tubing and casing.

42. A method for removing and/or preventing the build up of paraffin in an oil well comprising:

determining the location of the likelihood of paraffin deposits along the tubing of said well;

providing an induction heater;

positioning said induction heater outside of said tubing between said tubing and casing at said location;

and energizing said induction heater while at said location causing any paraffin deposited in said tubing to melt and be released from the walls of said tubing, said energizing step occurring in electrical pulses of relatively short duration.

43. Apparatus for removing and/or preventing the build up of paraffin in an oil well comprising:

means for determining the location of the likelihood of paraffin deposits along the tubing of said well;

an induction heater;

means for positioning said induction heater outside of said tubing between said tubing and casing at said location;

and means for energizing said induction heater while at said location by electrical pulses of relatively short duration.

44. The apparatus of claim 43, wherein said determining means includes a temperature measuring device.

45. The apparatus of claim 44, wherein said induction heater includes a plurality of heater portions, each said portion abutting another of said portions vertically adjacent thereto, said energizing means selectively and independently energizing each said heater portion.

46. The apparatus of claim 45, wherein said positioning means includes a pair of vertically spaced collars each having an aperture therethrough, means for selectively attaching each of said collars independently to said tubing, means for separating and converging said collars, and said induction heater secured to one of said collars.

* * * * *

UNITED STATES PATENT AND TRADEMARK OFFICE

CERTIFICATE OF CORRECTION

PATENT NO. : 4,538,682

DATED : September 3, 1985

INVENTOR(S) : McManus et al.

It is certified that error appears in the above-identified patent and that said Letters Patent is hereby corrected as shown below:

Column 1, line 41:
"an" , first occurrence, should read -- in --.

Column 3, line 23:
"includes" should be --included--

Column 7, line 52:
"has" should be --was--

Signed and Sealed this

*Fifth* Day of *August 1986*

[SEAL]

*Attest:*

DONALD J. QUIGG

*Attesting Officer*

*Commissioner of Patents and Trademarks*